United States Patent [19]

Puri et al.

[11] Patent Number: 4,883,122

[45] Date of Patent: Nov. 28, 1989

[54] METHOD OF COALBED METHANE PRODUCTION

[75] Inventors: Rajen Puri, Tulsa, Okla.; Michael H. Stein, Houston, Tex.

[73] Assignee: Amoco Corporation, Chicago, Ill.

[21] Appl. No.: 249,810

[22] Filed: Sep. 27, 1988

[51] Int. Cl.[4] ..... E21B 43/24; E21B 43/30; E21B 43/40

[52] U.S. Cl. ..... 166/263; 166/245; 166/266; 166/268; 166/272

[58] Field of Search ..... 166/245, 263, 266, 267, 166/268, 272, 303, 305.1; 299/12

[56] References Cited

U.S. PATENT DOCUMENTS

| | | | |
|---|---|---|---|
| 4,010,800 | 3/1977 | Terry | 166/272 X |
| 4,043,395 | 8/1977 | Every et al. | 166/263 |
| 4,130,164 | 12/1978 | Datta | 166/266 |
| 4,391,327 | 7/1983 | De Carlo | 299/12 |
| 4,446,921 | 5/1984 | Coenen et al. | 166/266 |
| 4,448,252 | 5/1984 | Stoddard et al. | 166/268 X |
| 4,544,037 | 10/1985 | Terry | 299/12 X |
| 4,662,439 | 5/1987 | Puri | 166/272 X |
| 4,756,367 | 7/1978 | Puri et al. | 166/263 |

FOREIGN PATENT DOCUMENTS

| | | | |
|---|---|---|---|
| 609917 | 6/1978 | U.S.S.R. | 299/12 |

OTHER PUBLICATIONS

A. A. Reznik et al., "An Analysis of the Effect of $CO_2$ Injection on the Recovery of In-Situ Methane from Bituminous Coal: An Experimental Simulation", Society of Petroleum Engineers Journal, Oct., 1984.

*Primary Examiner*—George A. Suchfield
*Attorney, Agent, or Firm*—L. Wayne White; Fred E. Hook

[57] ABSTRACT

A method of producing coalbed methane by injecting inert gas, such as nitrogen, through an injection well into the coal seam and recovering coalbed methane from a production well(s). Methane desorption from coal is achieved by reduction in methane partial pressure rather than by reduction in total pressure alone.

21 Claims, 6 Drawing Sheets

METHOD OF COALBED METHANE PRODUCTION

FIELD OF THE INVENTION

The present invention is a method of producing methane from a coal seam. More specifically, the invention is a method of producing methane from a coal seam by injecting an inert gas through an injection well into the coal seam to strip methane from the coal and sweep the produced gases into a production well.

BACKGROUND OF THE INVENTION

During the conversion of peat to coal, methane gas is produced as a result of thermal and biogenic processes. Because of the mutual attraction between the coal surface and the methane molecules, a large amount of methane can remain trapped in-situ. The reserves of such "coalbed methane" in the United States and around the world are huge.

Conventional coalbed methane recovery methods are based on reservoir pressure depletion strategy; that is, methane is desorbed from the coal surface by reducing the reservoir pressure in the coal cleat network. Thus, both water and methane gas are recovered simultaneously from a coalbed. While this method of coalbed methane production is simple, it is not efficient. Loss of reservoir pressure deprives the pressure depletion process of the driving force necessary to flow methane gas to the wellbores. Consequently, the gas production rate from a well is adversely affected by the reduction in reservoir pressure.

Another method of recovering coalbed methane is by injecting into the coal seam a gas, such as $C0_2$, having a higher affinity for coal than the adsorbed methane, thereby establishing a competitive adsorption/desorption process. In this process, the $C0_2$ displaces methane from the surface of coal, thereby freeing the methane so that it can flow to a wellbore and be recovered. This method is disclosed in the reference by A. A. Reznik, P. K. Singh, and W. L. Foley, "An Analysis of the Effect of $C0_2$ Injection on the Recovery of In-Situ Methane from Bituminous Coal: An Experimental Simulation," *Society of Petroleum Engineers Journal*, October 1984. The problem with this method is the large volume of $C0_2$ that must be injected into the coal seam in order to exchange sites with methane. In most coal seams, such an amount would be uneconomical. This reference reports that mixing even small amounts of nitrogen gas with $C0_2$ significantly reduces the effectiveness of displacement desorption of methane by $C0_2$.

There is a need for a method of producing coalbed methane from coal that accelerates the production rate and improves recoverable gas reserves economically.

SUMMARY OF THE INVENTION

The present invention overcomes the foregoing deficiencies and meets the above-described needs. The present invention is a method for producing coalbed methane from a coal seam penetrated by at least one producing well. The method comprises injecting an inert gas through the injection well and into the coal seam, and producing the inert gas and the coalbed methane from the production well. Coalbed methane recovery is accelerated and substantial improvement is made in the net recoverable reserves.

DETAILED DESCRIPTION OF THE INVENTION

Figure 1:
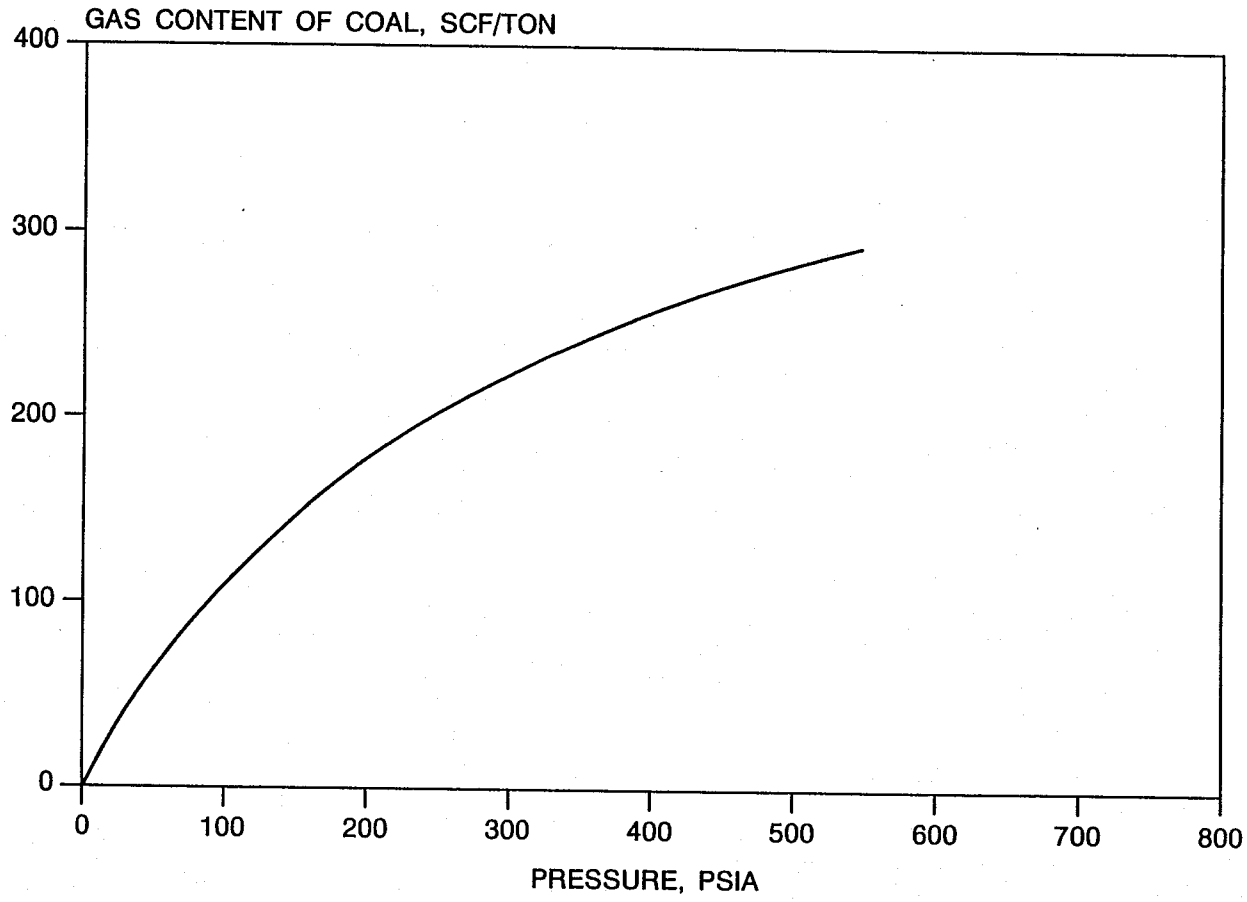
FIG. 1 is a graphical representation of a sorption isotherm illustrating the relationship between the reservoir pressure of a coal seam and the gas content of the coal. The sorption isotherm is a representation of the maximum methane holding capacity of coal as a function of pressure at a fixed temperature.
Figure 2:
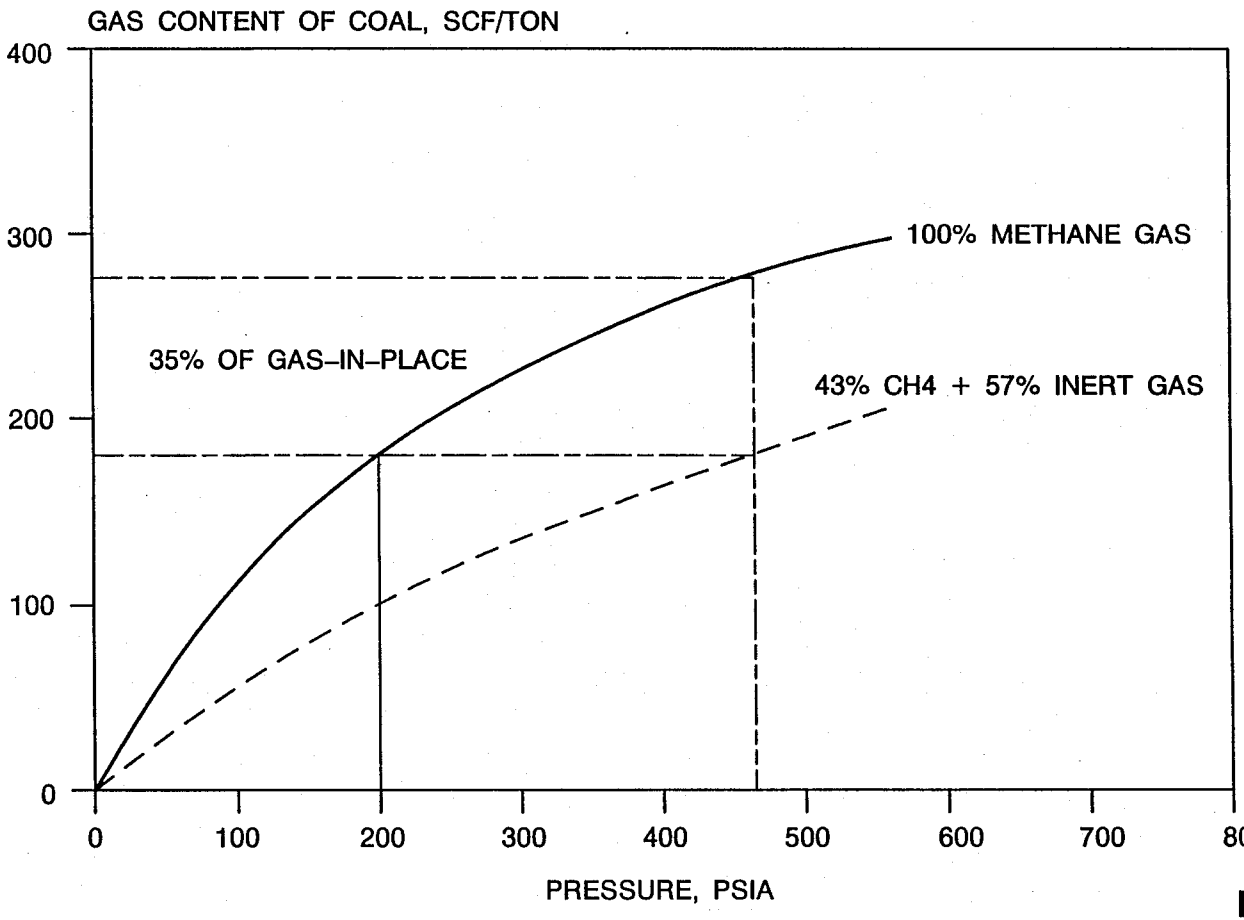
FIG. 2 is a graphical representation of a sorption isotherm of a coal sample in the presence of an inert gas.

The desorption of methane from the coal surface is controlled by the partial pressure of methane gas rather than the total system pressure. Therefore, methane is desorbed from coal as a result of reduction in methane partial pressure. The methane recovery from a coal seam can be accelerated and enhanced by the continuous injection of an inert gas into the coal seam. While the total reservoir pressure is maintained, if not increased, the partial pressure of methane is reduced. Inert gas is defined as a gas that does not significantly adsorb to the coal or react with the coal under conditions of use. Examples of inert gases include nitrogen, helium, argon, air and the like. Nitrogen is preferred based on current commercial availability and price. FIG. 2 shows the equilibrium sorption isotherm of a coal sample in the presence of an inert gas. As illustrated, 35% of the gas in place can be recovered from coal by either reducing the total pressure from 465 psi to 200 psi or by diluting the free methane gas concentration in coal with an inert gas so as to reach an equilibrium value of 43% methane and 57% inert gas without any change in the total pressure.

The use of inert gas to desorb methane from a coalbed is economically and technically feasible primarily because of the low effective porosity of coal (of the order of 1%). Injection of a relatively small amount of inert gas in coal causes a large reduction in the partial pressure of free methane gas in the cleat system. Consequently, methane is desorbed from coal until a new equilibrium is reached as per the sorption isotherm. The mixture of methane and inert gas flows across and through the coal seam along with water until it is recovered to the surface by means of producing wells. The produced gas is separated from water and recovered using known separation methods. Methane is separated from the inert gas also using known separation methods. The methane is then marketed, the inert gas can be recycled. Economics of the methods are enhanced by recycling the inert gas.

The novel inert gas stripping method of the present invention can be further improved by heating the inert gas before it is injected into the coal seam.

The injection pressure of the inert gas should preferably be lower than the fracture parting pressure of the coal seam but should be higher than the initial reservoir pressure. Maintenance of a constant injection pressure is also desirable, although not necessary.

The present invention requires at least one injection well and at least one production well. The number and location of the injection and production wells can be varied and will usually be determined after reservoir engineering and economics of a specific field project have been evaluated.

During the present process, the coal seam is dewatered, but reservoir pressure is not lost. This is an important advantage because maintenance of reservoir pressure in a coalbed methane field also helps reduce water migration from the surrounding aquifers. This is particularly advantageous in coal seams with high permeability and effective cleat porosity. Over the life of the coal degas project, the amount of water that is recovered from coal and disposed of can be reduced because of the reduced water migration in the field.

Inert gas injection can also be conducted in existing coal fields that have been on pressure depletion for a period of time prior to such injection. In this method, coalbed methane is produced through at least a first and second well. Then such production is ceased in the first well and inert gas in injected through the first well into the coal seam. Next the inert gas and coalbed methane is produced from the second well.

EXAMPLE

Figure 3A:
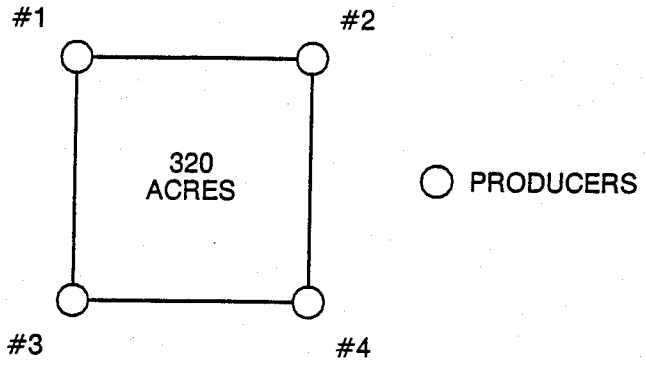
FIG. 3 is a top view of a four-spot repeating well pattern described in the Example.
Figure 3B:
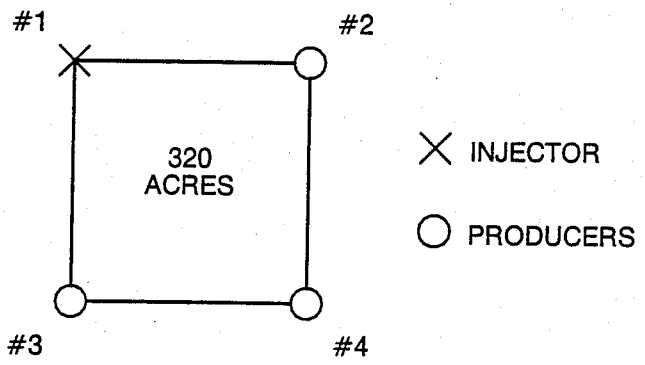

Four wells are drilled in a 320 acre square in a repeating well pattern (as shown in FIG. 3) and produced at total gas rates of approximately 1200 thousand standard cubic feet per day for a period of five years (base case) using a reservoir pressure depletion technique. At that time, one of the wells (No. 1) is converted into an injection well and nitrogen is injected through this well and into the coal seam for the next twenty years.

Figure 4:
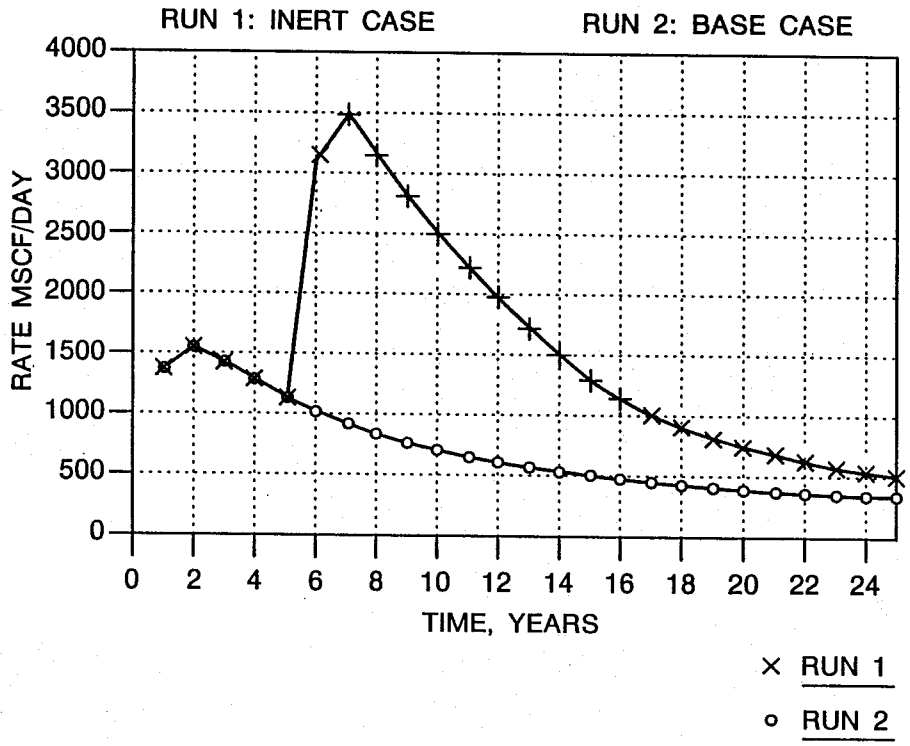
FIG. 4 is a graphical representation of the methane production rate versus time for the four spot repeating well pattern.
Figure 5:
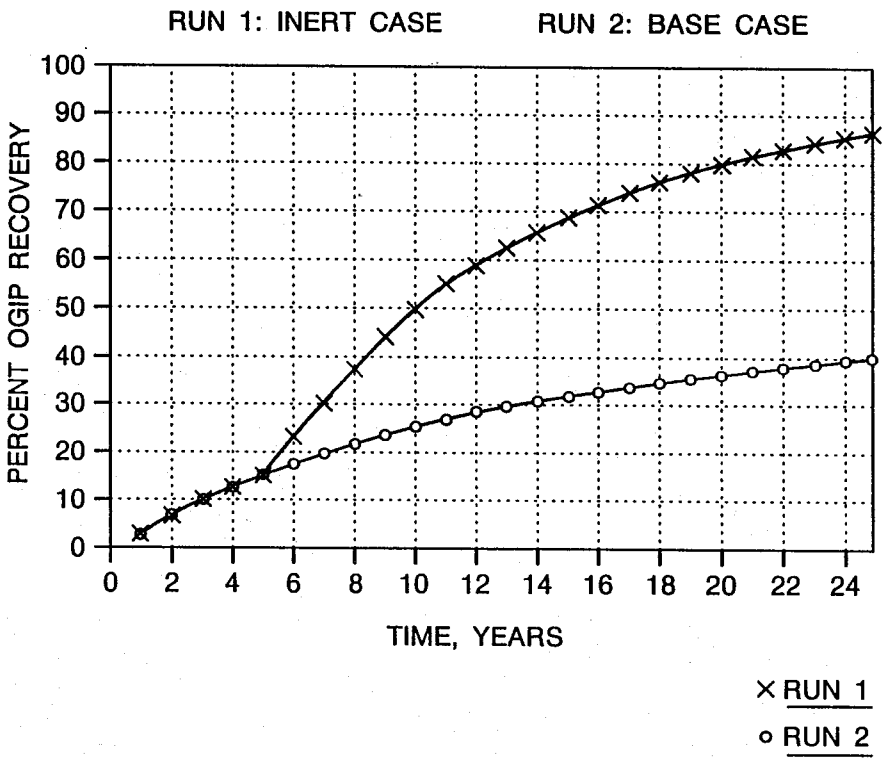
FIG. 5 is a graphical representation of the original gas in place recovered versus time for the four spot repeating well pattern.
Figure 6:
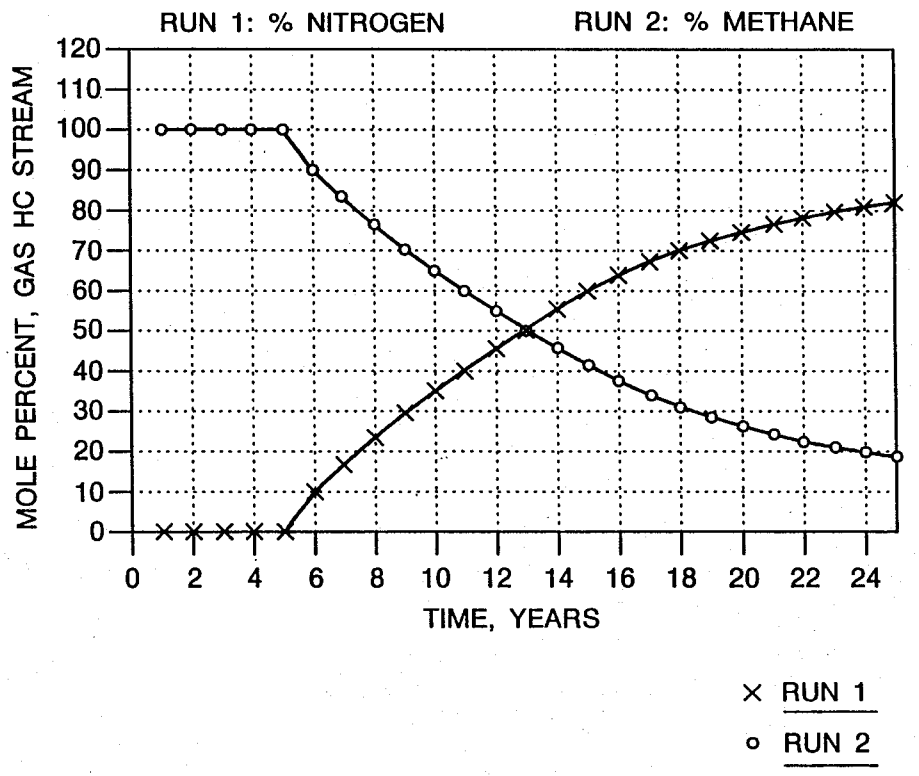
FIG. 6 is a graphical representation of the mole percent of gas produced versus time for the four spot repeating well pattern.

FIG. 4 shows the gas production rates for the four producing wells of the base case and for the three producing wells during $N_2$ injection. As shown, methane recovery from the field increases substantially when $N_2$ injection is initiated. FIG. 5 shows the percent of original gas in place recovered for the base case and for the three producing wells during $N_2$ injection. As illustrated, the injection of inert gas in the field increases the net recoverable reserves of methane gas by more than a factor of 2. The composition of the produced gas is shown as a function of time in FIG. 6.

This example shows that inert gas injection in coal is of considerable value in accelerating and enhancing methane recovery from coal.

The present invention has been described in particular relationship to the attached drawings. However, it should be understood that further modifications, apart from those shown or suggested herein, can be made within the scope and spirit of the present invention.

What is claimed is:

1. A method for producing coalbed methane from a coal seam containing coalbed methane and penetrated by at least one injection well and at least one producing well, said method comprising the steps of:

(a) injecting an inert gas through the injection well and into the coal seam; said inert gas being a gas that (i) does not react with the coal under conditions of use and (ii) that does not significantly adsorb to the coal; and (b) producing a gas from the production well which consists essentially of the inert gas, coalbed methane, or mixtures thereof.

2. A method of claim 1 wherein the inert gas is selected from the group consisting of nitrogen, helium, argon and air.

3. A method of claim 1 wherein the inert gas is nitrogen.

4. A method of claim 1 wherein the injection pressure is maintained substantially constant.

5. A method of claim 1 wherein the coalbed methane gas produced in step (b) is separated from produced gases.

6. A method of claim 1 wherein water is produced in step (b) and separated from the inert gas and the methane.

7. The method of claim 1 wherein said inert gas is injected into the coal seam by continuous injection.

8. A method for producing coalbed methane from a coal seam containing coalbed methane and penetrated by at least a first and a second well, said method comprising the steps of:

(a) producing coalbed methane from the coal seam from the first and second wells;

(b) ceasing the production of coalbed methane from the first well and injecting an inert gas through the first well into the coal seam; and (c) producing a gas from the second well which consists essentially of the inert gas, coalbed methane, or mixtures thereof.

9. A method of claim 8 wherein the inert gas is selected from the group consisting of nitrogen, helium, argon and air.

10. A method of claim 8 wherein the inert gas is nitrogen.

11. A method of claim 8 wherein the injection pressure is maintained substantially constant.

12. A method of claim 8 wherein the inert gas is injected at a pressure less than reservoir parting pressure but greater than initial reservoir pressure.

13. A method of claim 12 wherein the inert gas is selected from the group consisting of nitrogen, helium, argon and air.

14. A method of claim 12 wherein the inert gas is nitrogen.

15. A method of claim 12 wherein the injection pressure is maintained substantially constant.

16. A method of claim 12 wherein the inert gas produced in step (b) is separated from the methane.

17. A method of claim 12 wherein water is produced in steps (a) and (c) and separated from produced gases.

18. A method of claim 12 wherein said inert gas is injected into the coal seam by continuous injection.

19. A method of claim 8 wherein the inert gas produced in step (b) is separated from the methane.

20. A method of claim 8 wherein water is produced in steps (a) and (c) and separated from produced gases.

21. The method of claim 8 wherein said inert gas is injected into the coal seam by continuous injection.

* * * * *